United States Patent [19]

Albrecht et al.

[11] Patent Number: 4,693,294

[45] Date of Patent: Sep. 15, 1987

[54] APPARATUS FOR PRODUCING BY THE CASTING TECHNIQUE A COOLING MEANS FOR WEBS BETWEEN ADJACENT CYLINDERS OF A CYLINDER BLOCK AND A CYLINDER BLOCK PRODUCED ACCORDINGLY

[75] Inventors: Karl-Hans Albrecht, Dillingen; Hartmut Lühr, Saarbrücken-Brebach; Günter Pieck, Saarbrücken-Fechingen, all of Fed. Rep. of Germany

[73] Assignee: Halbergerhutte GmbH, Fed. Rep. of Germany

[21] Appl. No.: 843,745

[22] Filed: Mar. 25, 1986

[30] Foreign Application Priority Data

Apr. 2, 1985 [DE] Fed. Rep. of Germany ..... 3512076

[51] Int. Cl.[4] ..... B22D 33/04

[52] U.S. Cl. ..... 164/312; 164/340; 123/41.74

[58] Field of Search ..... 123/41.74, 41.79, 493 C, 123/195 R; 164/340, 31, 312; 29/527.5

[56] References Cited

U.S. PATENT DOCUMENTS

| | | | |
|---|---|---|---|
| 3,186,387 | 6/1965 | Kolbe et al. | 164/340 |
| 3,942,487 | 3/1976 | Zink | 123/41.74 |
| 4,586,553 | 5/1986 | Allen et al. | 164/340 |

*Primary Examiner*—William A. Cuchlinski, Jr.
*Attorney, Agent, or Firm*—Reese Taylor

[57] ABSTRACT

In an apparatus for producing, by the casting technique, a cooling means for narrow webs between adjacent cylinders in a cylinder block, separate cores are provided which are fitted at both ends into a water jacket core or into the bottom core in order to form cooling water channels in the webs. The cylinder blocks produced by the apparatus have in their web areas cooling water channels which are connected with the water jacket.

7 Claims, 8 Drawing Figures

A
B
C
D-D
E
1
2
3
4
4c
5
7
7a
7b

E-E
D
1
2
3
4
4a
4b
4c
5
7
7a
7b
8
9

A-A
4a
4b
7

B-B
4a
4b
7a

C-C
4a
4b
7b

APPARATUS FOR PRODUCING BY THE CASTING TECHNIQUE A COOLING MEANS FOR WEBS BETWEEN ADJACENT CYLINDERS OF A CYLINDER BLOCK AND A CYLINDER BLOCK PRODUCED ACCORDINGLY

RELATED APPLICATIONS

This application claims priority under 35 U.S.C. 119 based on Federal Republic of Germany Application No. P 35 12 076.2 filed Apr. 2, 1985.

BACKGROUND OF THE INVENTION

When producing cylinder blocks for water-cooled reciprocating engines, there is an increasing tendency to cast the cylinders together as close as possible in order to realize a short structural shape of the cylinder block. This close arrangement of cylinders leads to web areas with a thickness of less than 9 mm, and in particular less than 8.5 mm in the finished state. The cooling of such cylinder blocks has been effected up to now by aid of a water jacket surrounding the cylinder walls on both longitudinal sides and the two front sides of the cylinder block.

The inventor has now recognized that the danger of knocking in such reciprocating engines and problems with regard to the cylinder packing of such cylinder blocks are due, in particular in the case of highly loaded engines, to thermal problems resulting from insufficient cooling of the narrow web areas between extremely closely arranged cylinders. Due to the very small web thicknesses, however, it is very problematic to provide appropriate cooling means for the web area.

The invention is based on the problem of providing an apparatus making it possible to realize in a simple and reliable manner a cooling means for webs of very closely adjacent cylinders of a cylinder block.

SUMMARY OF THE INVENTION

According to the invention, separate cores are used which bridge the two longitudinal sides of the jacket core in the subsequent web areas of the cylinder and serve to form cooling water channels which finally connect the two longitudinal halves of the water jacket with each other, thereby ensuring that heat is carried off from the very narrow webs due to water circulation. The separate cores are advantageous in that they are substantially independent in terms of their shape and the choice of material of the jacket core proper which is used to form the water jacket. This is very essential because the cores must be dimensioned extremely small and thus constitute special danger points when casting the cylinder block, and these conditions can be taken into account by appropriately shaping the core and choosing the right material therefor. Only with such separate cores can sand molded cavities for conducting cooling water be provided by the casting technique, which was not achieved up to now.

According to an embodiment, the cooling water channel of a web directly connects the two longitudinal halves of the water jacket. For this purpose, the core is directly fitted or arranged at its two opposite ends in the corresponding longitudinal sides of the jacket core.

According to a further embodiment, the core is not fitted in the jacket core but in a bottom core above the head end of the cylinder block to be molded. The connection with the water jacket is then established by providing two bores leading from the head end of the cylinder block to the particular longitudinal halves of the water jacket. The latter embodiment is particularly suitable for engines with so-called steam bores or steam ports from the head end of the cylinder block to the longitudinal halves of the water jacket. The bores required for the steam holes thus also provide at the same time the connection of the cooling water channels in the web with the two longitudinal halves of the water jacket.

The cores for forming the cooling water channels are expediently formed of zircon sand with a very fine grain in order to obtain a high bulk density and thus great solidity of the special core.

The cores for forming the cooling water channels are expediently formed so as to grow wider in a trumpet-like manner starting from the narrowest point of the web on a plane of symmetry of the cylinders horizontally to the longitudinal halves of the water jacket. Alternatively, the cooling water channels may grow wider in such trumpet-like manner vertically to the longitudinal halves of the cooling water jacket or, in the case of a separate core, the core may be provided with a U-shaped portion whose two arms coincide with steam holes in the housing of the cylinder block.

This improves the flow behavior of the cooling water through the cooling water channels and thus the cooling web, on the other hand, while obtaining sufficient core strength in the area of the point of attachment between the core of the cooling water channels and the jacket core, on the other hand, to obtain a good bond between the jacket core and the special cores for the cooling water channels, which are fitted at both ends into the jacket core and glued there.

Also a cylinder block having narrow webs between adjacent cylinders each having, at least at the level of the cylinder combustion chambers, at least one preformed cooling water channel which connects the two longitudinal halves of the water jacket with each other either directly or after two bores have been provided from the head end of the cylinder block is characterized by very good heat dissipation even in the critical web areas and even in the case of highly loaded engines, thereby reducing packing problems and the danger of knocking.

In the following, embodiments of the invention shall be described with reference to the drawing.

BRIEF DESCRIPTION OF THE PREFERRED EMBODIMENT

Figure 1:
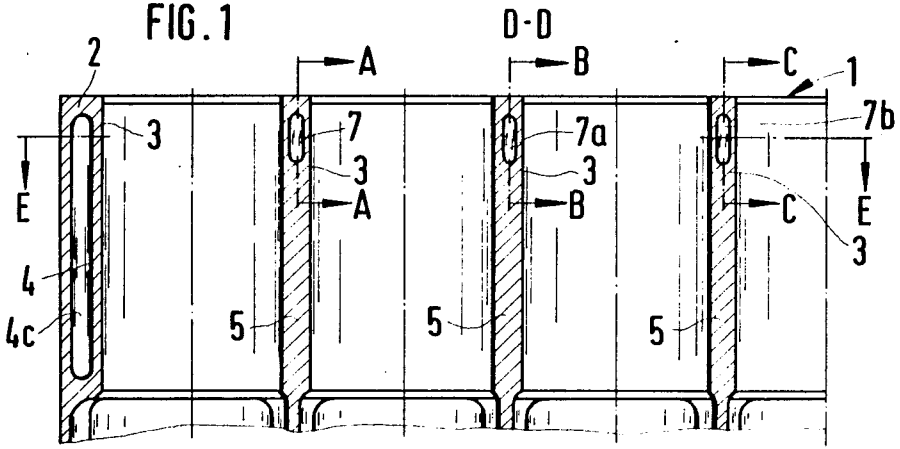
FIG. 1 is a longitudinal cross-section of a cylinder block of a multicylinder reciprocating engine (cross-section D—D of FIG. 2).
Figure 2:
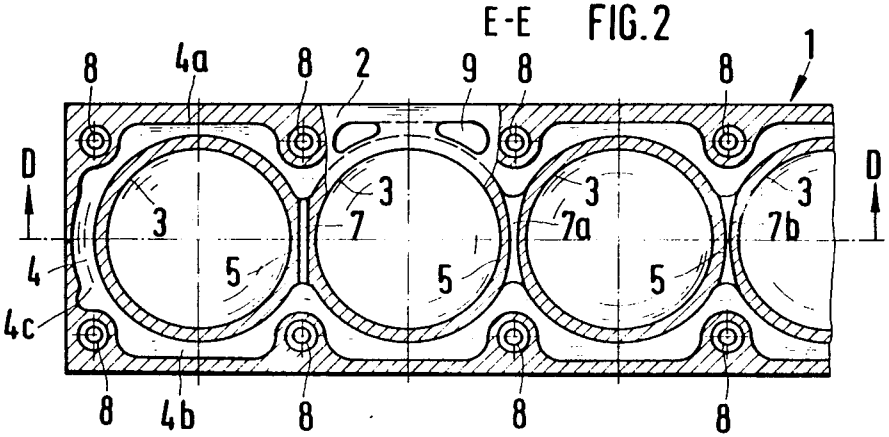
FIG. 2 is a top view of a cylinder block according to FIG. 1 along cross-sectional line E—E of FIG. 1.

FIGS. 1 and 2 show a cylinder block, referred to as 1 and produced by the casting techinque, of a (for example) four-cylinder water-cooled reciprocating engine in a series construction. Housing 2 of cylinder block 1 includes a plurality of cylinders 3 in tandem which are cast together very close to achieve a structural shape which is as short as possible, leaving only extremely narrow webs 5 between the adjacent cylinders 3. Due to the very close arrangement of the cylinders, the remaining webs 5 have thicknesses not exceeding 9 mm, in particular smaller than 8.5 mm in the finished state.

The cylinder block shown in FIGS. 1 and 2 is cooled in the usual way by a water jacket 4 composed of two longitudinal halves 4*a*, 4*b* on both longitudinal sides of cylinder block 1 and frontal sections 4*c*. Water jacket 4 is produced in the usual way by a jacket core which is not shown.

To cool the narrow web area, preformed cooling water channels 7, 7*a*, 7*b* (cf. FIG. 3) are cast in the upper area of webs 5, in particular at the level of the cylinder combustion chamber, i.e. in the area in which the combustion chambers are formed in the upper dead center position of the pistons. Cooling water channels 7, 7*a*, 7*b* connect the two longitudinal halves 4*a*, 4*b* of water jacket 4 so that cooling water also circulates through the narrow webs. The cross-section of cooling water channels 7, 7*a*, 7*b* is dimensioned so as to ensure that cooling water flows through sufficiently. In the preferred embodiment shown, one cooling water channel is arranged per web at the level of the cylinder combustion chamber.

The production by the casting technique of the cooling water channels, which are separated from the adjacent clyinder spaces by web wall sections with a thickness in the range of about 2.5 mm or less in the finished states of the cylinder block, is effected by separate cores which are fitted into the jacket core after the jacket core for water jacket 4 has been completed. The cores for the cooling water channels bridge the two opposite longitudinal sides of the water jacket core and are anchored there in corresponding recesses, in particularly by gluing. The separately shot, i.e. separately produced, cores of the cooling water channels are preferably arranged at the level of the subsequent cylinder combustion chambers of the cylinder block.

A suitable material, in particular a special sand with a special sand grain which is highly compressed, is used for the cores of the cooling water channels to give them very high solidity. Zircon sand with a very fine grain is particularly suitable for the core. The shooting pressure for the cores is between 2 and 7 bar, in particular 6 and 7 bar, and the average grain size is expediently 0.15 to 0.2 mm.

Figure 3:
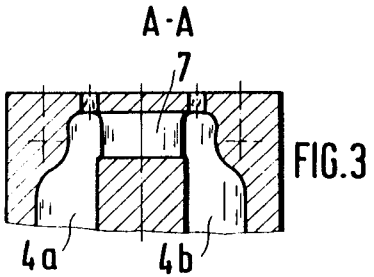
FIGS. 3 to 5 are details in the cross-section along lines A—A, B—B and C—C of the cylinder block according to FIG. 1.
Figure 4:
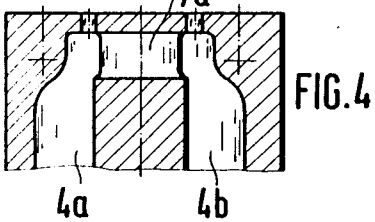
Figure 5:
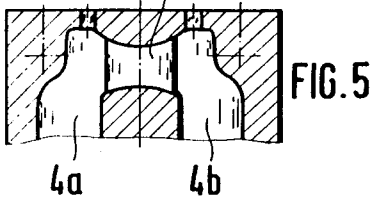

FIGS. 3 to 5 show different embodiments of cooling water channels, the core having a complementary shape to the cooling water channels shown in FIGS. 3 and 5.

According to FIG. 3, cooling water channel 7 has a constant cross-section along its length (cf. also left-hand web of FIG. 2), the cross-section being substantially rectangular with its narrow sides bulged outwardly according to the view of FIG. 2.

According to FIG. 4, cooling water channel 7*a* has a constant height along its entire length, but has a varying width, as can be seen in FIG. 2, the middle view of the web. Starting from the narrowest point of web 5 on the plane of symmetry of the cylinders, cooling water channel 7*a* grows wider on both sides horizontal to longitudinal halves 4*a*, 4*b* of the water jacket in a trumpet-like manner. This not only improves the flow behavior of the coolant but also creates a sufficiently large area in the vicinity of the point of attachment of the special core to the core proper of the water jacket for a precisely fitting bond of the core for the cooling water channel with the jacket core.

The same advantages are provided by the embodiment of a cooling water channel 7*b* according to FIG. 5 which has a varying height. Starting from the narrowest point of the web in the area of the plane of symmetry of the cyinders, cooling water channel 7*b* grows wider on both sides vertically to longitudinal halves 4*a*, 4*b* of water jacket 4. Alternatively, cooling water channel 7*b* may also have a varying width analogous to the embodiment in FIG. 4, as can be seen in particular in FIG. 2, righthand view of cooling water channel 7*b*.

Figure 6:
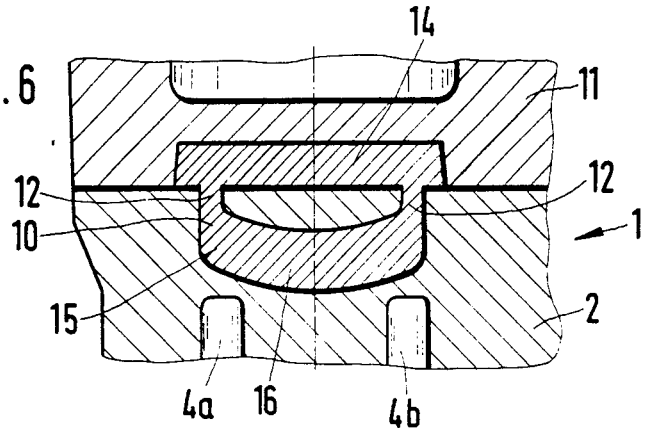
FIG. 6 is a further embodiment of a cylinder block with an additional core and bottom core corresponding to cross-section A—A of FIG. 1.

FIG. 6 shows a further embodiment of a core for producing cooling water channels within webs 5, which differs from the preceding embodiments in that the cooling water channels produced by the core do not directly connect the two longitudinal halves 4*a* and 4*b* of water jacket 4 with each other but the connection is only established by additional bores which are provided from the side on the top in the figure, i.e. the head end of the cylinder block. FIG. 6 shows at the bottom only in part the two longitudinal halves 4*a* and 4*b* in housing 2 of cylinder block. Thereabove, on the plane of webs 5 (see FIG. 8) the separate core or additional core 10 is located in each case, made of the same material as the separate cores in the embodiments according to FIGS. 1 to 5. The additional core according to FIG. 6 is fixed in the so-called bottom core 11. This bottom core 11, which serves to form a so-called mounting plate, also bears the cores for cylinder bores 3 of cylinder block.

Figure 7:
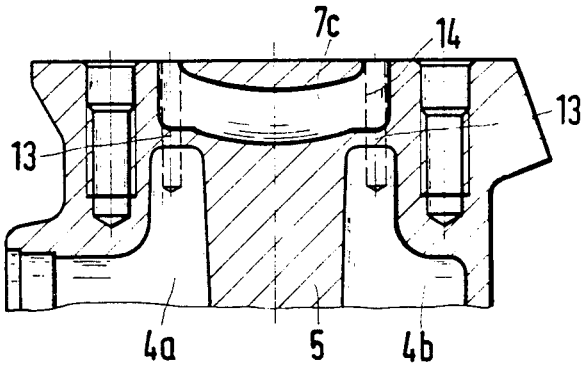
FIG. 7 is a cross-section according to FIG. 6 after a casting process.

Like the preceding separate cores, additional core 10 is a lost core, the cooling water channel 7*c* seen in FIG. 7 then resulting after the casting process within the cylinder block in each web 5. Cooling water channel 7*c* is also preferably arranged in the upper area of web 5. Due to the shape of additional core 10 as seen in FIG. 6, with upwardly pointing arms 12, there is no direct connection of the two cooling water channels 4*a*, 4*b* by cooling water channel 7*c*; cooling water channel 7*c* instead opens out on each side on the upper side of housing 2 of cylinder block 1. The connection of cooling water channel 7*c* with the two longitudinal halves 4*a*, 4*b* of water jacket 4 is effected by two separately provided bores 13 per web 5, as can be seen in FIG. 7. These bores are provided by aid of drills 14 shown by dotted lines in FIG. 7. In this embodiment as well, it is unnecessary to change the construction of the engine in order to cool the cylinder block even in the close webs because bores 13 are usually provided in the cylinder blocks by drills 14 as so-called steam holes, i.e. they are already present in the cylinder block.

Figure 8:
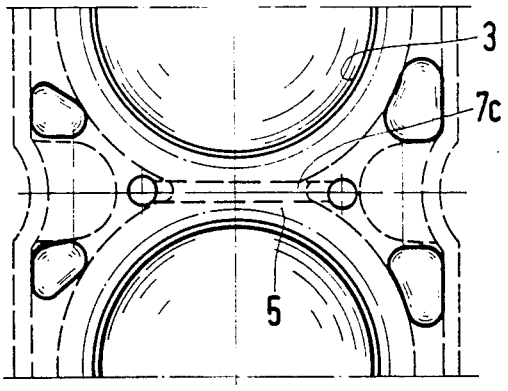
FIG. 8 is a top view of the cylinder block according to FIGS. 6 and 7.

These bores serve the purpose of preventing nests of steam from forming by carrying off steam. This embodiment is thus in particular suitable for such engines in which steam holes are already bored from the upper side to water jacket 4. FIG. 8 shows the two openings of cooling water channel 7*c* on the upper side of cylinder block 1. As FIG. 6 shows, additional core 10 consists substantially of a transverse portion 14, with which additional core 10 is fitted in bottom core 11, and a U-shaped portion 15 to form cooling water channel 7*c* in web 5. Cooling water channel *7c* proper is formed by U-bar 16, whereas the two U-arms coincide with the axis of the steam holes, thereby in practice forming part of the steam holes which are then completed by the provided bores up to water jacket 4, simultaneously forming connecting channels 13 between cooling water channel 7c and longitudinal halves 4a and 4b of water jacket 4.

While a full and complete description of the invention has been set forth in accordance with the dictates of the patent statutes, it should be understood that modifications can be resorted to without departing from the spirit hereof or the scope of the appended claims.

What is claimed is:

1. An apparatus for producing, by the casting technique, a cooling means for webs between adjacent cylinders cast extremely close together in a cylinder block of a reciprocating engine whose cylinder walls are surrounded on both longitudinal sides and front sides of the cylinder block by a water jacket, with a jacket core to form the water jacket, comprising separate cores disposed in the web (5) to form cooling water channels (7, *7a*, *7b*) which bridge the two opposite longitudinal sides of said jacket core at the level of the cylinder combustion chamber, said separate cores being either fitted at both ends into said jacket core or fixed in an upper bottom core (11).

2. The apparatus according to claim 1 wherein said separate cores are fitted at both ends into the water jacket core.

3. The apparatus according to claim 1 wherein a bottom core (11) is disposed adjacent the bottom of the cylinder block; said separate cores being fitted in said bottom core.

4. The apparatus according to claim 1 wherein said separate cores for the cooling water channels (7, *7a*, *7b*) are formed of highly compressed zircon sand independently of the jacket core or bottom core (11).

5. The apparatus according to claims 1, 2, 3 or 4 wherein said separate cores for the cooling water channels (7, *7a*, *7b*) grow wider in a trumpet-like manner starting from the narrowest point of the webs (5) on a plane of symmetry of the cylinders horizontally to the longitudinal halves (*4a*, *4b*) of the water jacket (4).

6. The apparatus according to claims 1, 2, 3 or 4 wherein said cooling water channels grow wider in a trumpet-like manner starting from the narrowest point of the web (5) on a plane of symmetry of the cylinders (3) vertically to the longitudinal halves (*4a*, *4b*) of the cooling water jacket (4).

7. The apparatus according to claim 3 wherein said separate core (10) has a U-shaped portion (15) whose two arms coincide with steam holes in the housing (2) of the cylinder block (1).

* * * * *